US005088952A

United States Patent [19]

Goldblatt

[11] Patent Number: 5,088,952

[45] Date of Patent: Feb. 18, 1992

[54] INFLATABLE AIR-HOVERABLE TOY HAVING STEMS FOR SPINNING

[76] Inventor: Robert L. Goldblatt, 1831 Selby #201, Los Angeles, Calif. 90025

[21] Appl. No.: 711,206

[22] Filed: Jun. 6, 1991

[51] Int. Cl.[5] ..... A63H 3/06; A63H 1/00

[52] U.S. Cl. ..... 446/220; 446/225; 446/236

[58] Field of Search ..... 446/220, 221, 222, 223, 446/224, 225, 226, 236, 901

[56] References Cited

U.S. PATENT DOCUMENTS

| | | | |
|---|---|---|---|
| 1,994,202 | 3/1935 | Sarsfield | 446/222 X |
| 2,759,296 | 8/1956 | Freck | 446/221 X |
| 2,927,383 | 3/1960 | Longino | 446/222 X |
| 3,529,823 | 9/1970 | Garver | 446/901 X |
| 3,879,887 | 4/1975 | Brookson, Jr. et al. | 446/220 |
| 3,900,638 | 8/1975 | Du Bato | 446/220 X |
| 4,307,537 | 12/1981 | Bergmann | 446/222 |
| 4,547,167 | 10/1985 | Bergmann | 446/220 |
| 4,580,990 | 4/1986 | Avery | 446/220 X |
| 4,693,695 | 9/1987 | Cheng | 446/220 |
| 4,892,500 | 1/1990 | Lau | 446/221 |

FOREIGN PATENT DOCUMENTS

| | | | |
|---|---|---|---|
| 1228892 | 10/1986 | Japan | 446/220 |
| 7900569 | 8/1979 | PCT Int'l Appl. | 446/220 |

*Primary Examiner*—Mickey Yu
*Assistant Examiner*—D. Neal Muir
*Attorney, Agent, or Firm*—Jacobson and Johnson

[57] ABSTRACT

A pair of generally circular panels or sheets of suitable material such as silvered Mylar are sealed together along their edges to form an envelope for receiving a lighter-than-air gas to form an air-hovering toy and short, generally cylindrical, stems are attached to and extend outward from the center of each of the panels so that the stems can be grasped to spin the toy about an axis defined by a line between the centers of the stems to make it into an action toy.

4 Claims, 2 Drawing Sheets

INFLATABLE AIR-HOVERABLE TOY HAVING STEMS FOR SPINNING

BACKGROUND OF THE INVENTION

Airborne, free-floating or hovering toys of the nature with which the instant invention is concerned are well-known and are commercially available and have become very popular. U.S. Pat. No. 4,307,537 by Bergmann and U.S. Pat. No. 4,038,777 describe in detail toys of this nature. As described in more detail in the aforesaid patents, a closed envelope may be made up of two thin circular sheets or panels of very lightweight, unstretchable material which is impervious to air or gas, such as polyethylene terephthalate (Mylar) laminated with aluminum foil, sealed together along their edges and the envelope is filled with helium or other suitable lighter-than-air gas. A toy created in this fashion takes the general shape of what has become known as a flying saucer. Conventionally, the envelope has a filling tube through which the gas is inserted to inflate the toy and then the tube is crimped or otherwise closed off in some convenient fashion. In general the amount of gas in the toy is balanced against the weight of the panels and ballast which can be added or removed so that the toy will hover at different elevations or float freely upward.

SUMMARY OF THE INVENTION

A conventional inflated aluminum-coated or silvered Mylar toy in the shape of a "flying saucer", similar to the toy illustrated and described in the aforementioned '537 and '777 patents, is modified by attaching short stems or stubs opposite one another at the centers of the panels or sides which form the envelope. The stems are attached at a location and are of a configuration so that they can be grasped by the fingers to spin the gas-filled toy about an axis defined by a line between the centers of the stems so that the toy can then be used as an aerodynamic action toy.

The stems are made of lightweight material such as cork or balsa to provide only a small amount of ballast so that the toy will be able to rise when inflated.

Preferably the stems are held in place by a disk of silvered Mylar (aluminum-coated or laminated) for appearance purposes and also to minimize the additional weight or ballast placed on the toy.

As an added feature, the outer tips of the stems may be provided with a fastener, such as Velcro, so that ballast or other articles can be attached to the tips of the stems or two or more toys of the same type can be attached to one another stem-to-stem.

DESCRIPTION OF THE PREFERRED EMBODIMENTS

A "flying saucer" toy 10 conventionally is formed out of two co-extensive circular panels 11 and 12 of suitable material. The aforementioned '537 and '777

Figure 1:
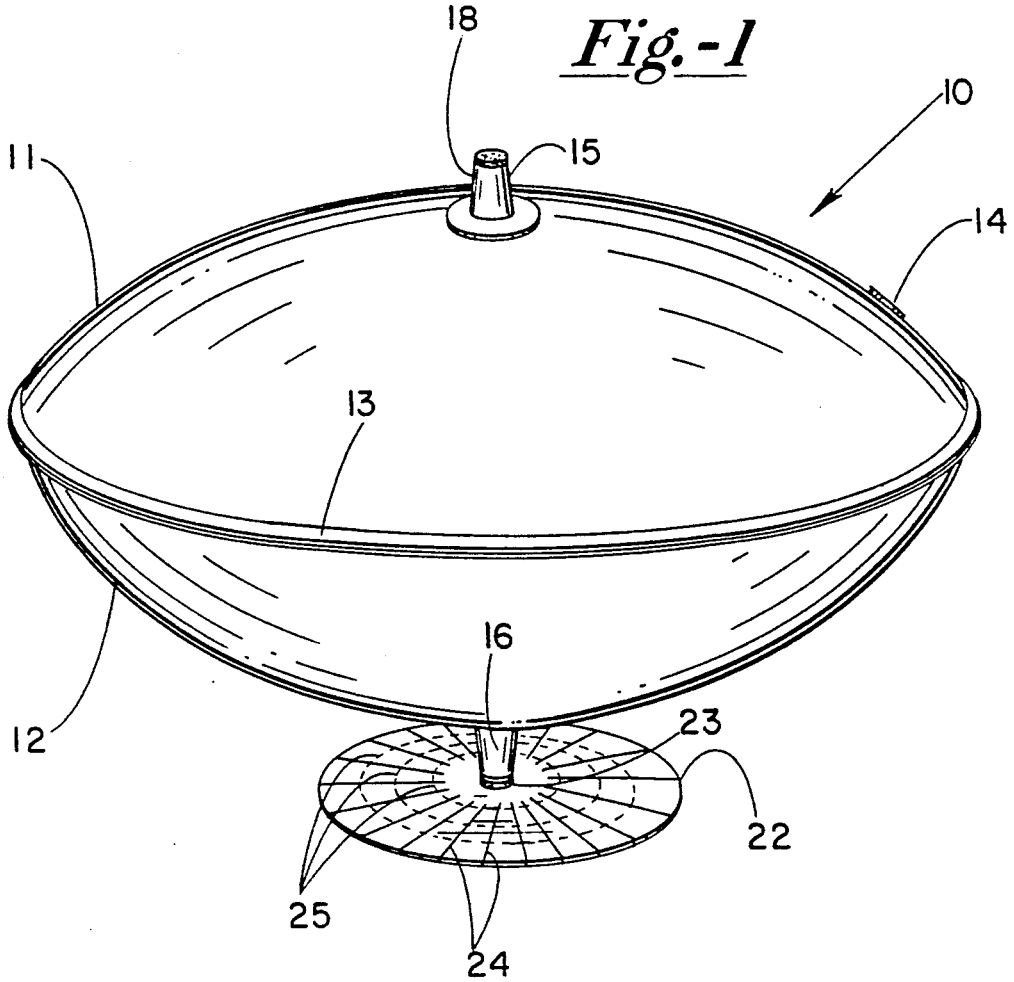
FIG. 1 is a perspective view of an inflated air-borne hovering toy made in accordance with the teachings of the instant invention with a ballast disc attached.
Figure 2:
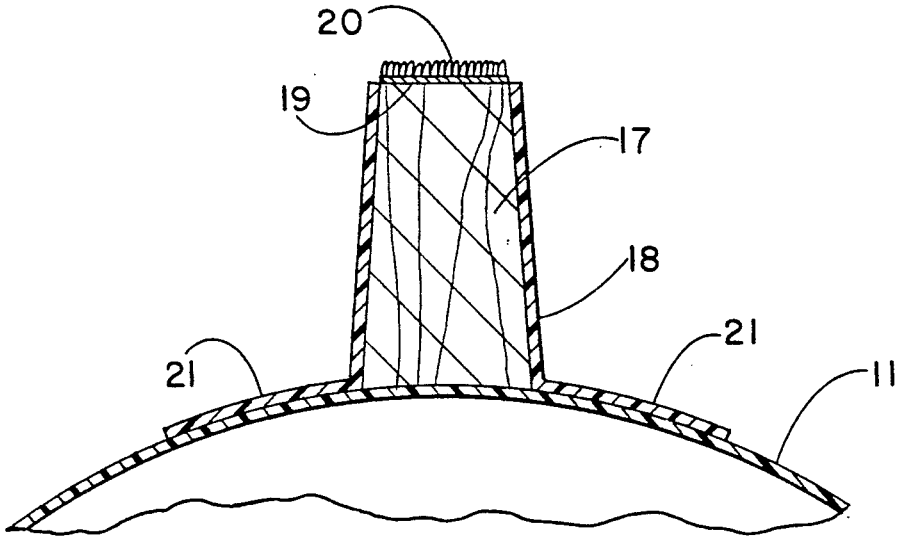
FIG. 2 illustrates a preferred manner of attaching the stems to the body or envelope of the toy.

U.S. patents as well as U.S. Pat. No. 4,290,763 by Hurst describe in detail materials which can be used and which are commercially available. One type of popularly used material is polyethylene terephthalate (Mylar) which has a coating or laminate, such as aluminum, to make it gas impervious and to give it a flashy silvery appearance. This material is sometimes referred to as silvered Mylar. Hereinafter the toy and/or the envelope or panels may be identified as being silvered Mylar but it should be understood that no limitation thereto is intended and that other suitable materials having similar characteristics can be used to provide the features and functions of the invention. In any event, panels 11 and 12 are sealed together along their outer edges 13 to form an inflatable envelope. Conventionally, one of the panels is provided with a filling tube 14 through which a lighter-than-air gas such as helium or the like is inserted to inflate the envelope. The filling tube 14 is then folded back on itself or otherwise crimped shut and held in place in some convenient fashion against the inflated envelope to keep the gas from leaking out. Conventionally, the amount of ballast will determine how high the toy rises. Oftentimes the toy is made to hover at a generally constant elevation with provisions for adding ballast to make it hover at a lower level and for removing ballast so that it will elevate further. Typically a toy of this nature will hover as illustrated in FIG. 1 with its wide sides generally horizontal and is moved about by outside wind or by air currents in a room. The conventional "flying saucer" inflated toy of this type is modified by the instant invention by attaching to the outside center of each of the panels 11 and 12 a pair of radially extending lightweight stems 15 and 16 directly opposite one another. FIG. 2 illustrates in more detail the manner in which stems 15 and 16 may be attached to the inflatable toy 10. Only one stem is shown but the illustration applies to both stems. The cores 17 of stems 15 and 16 are made of some lightweight material such as cork or balsa wood and may be slightly tapered inward as they extend radially outward from the associated panel 11 or 12. Alternatively, cores 17 may be straight-sided cylindrical pegs or stubs. Preferably core 17 is held in place on the balloon by a disk 18 of silvered Mylar which has a center opening 19 for core 17 and which covers over the exterior of core 17 and flares out at 21 over a portion of panels 11 and 12 and is sealed to the panel by any conventional or convenient means such as by heat or suitable adhesive or combination thereof. The outer end of core 17 preferably has a layer 20 of a suitable fastener, such as Velcro, so that if desired an article having a mating Velcro fastener can be attached or a similar toy can be attached stem-to-stem. For example, a ballast disc 22 may be attached via a mating piece of Velcro fastener 23 at the center of the disk.

Figure 3:
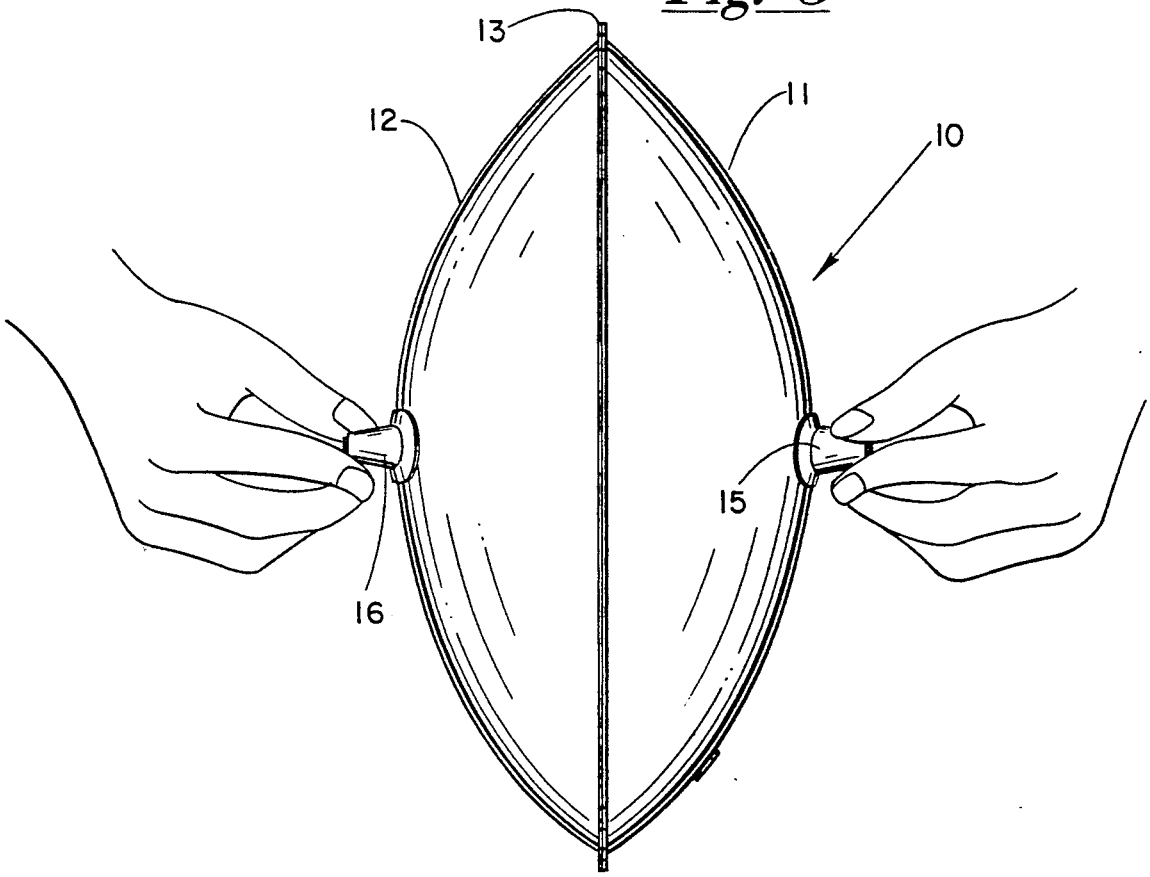
FIG. 3 illustrates how the stems can be grasped to spin the toy to give it aerodynamic motion.

As illustrated more clearly in FIG. 3, stems 15 and 16 can be grasped by the fingers and with a quick twist the inflated toy 10 can be made to rotate about an axis constituting the imaginary line between the centers of stems 15 and 16. When the user or player holds the toy so that the wide sides of the toy are generally vertical rather than horizontal and gives a quick twist with the fingers so that the toy spins in a direction away from the user and is then released, it should cause the toy to move forward and downward as it twirls about. When spun in the other direction and released, the toy should move upward and forward. The aerodynamic action and motion imparted to the toy by being able to grasp and spin the attached pegs or stems provides the means whereby the toy can now be used as an action play toy or even as a game toy. Also, the ability to spin the toy may enhance its attraction from a cosmetic viewpoint. For example, the outside of the toy panels can be painted or marked up with different colors and/or designs so that when the toy is spun it provides a colorful, changing, eye-catching pattern. As another possibility, the toy can be moved about as described to be used in competitive games with the users trying to see how far the toy can be moved, how long it may be made to spin, if it can be made to reach a specific target, etc. All of these uses (and others) are possible depending on the whims and imaginations of the users. The point is that attaching stems in a fashion and for the purpose described provide the means for making an inactive relatively motionless toy into an action and playful toy to add to its popularity without detracting from its appearance or from its original role as a hovering toy.

Figure 4:
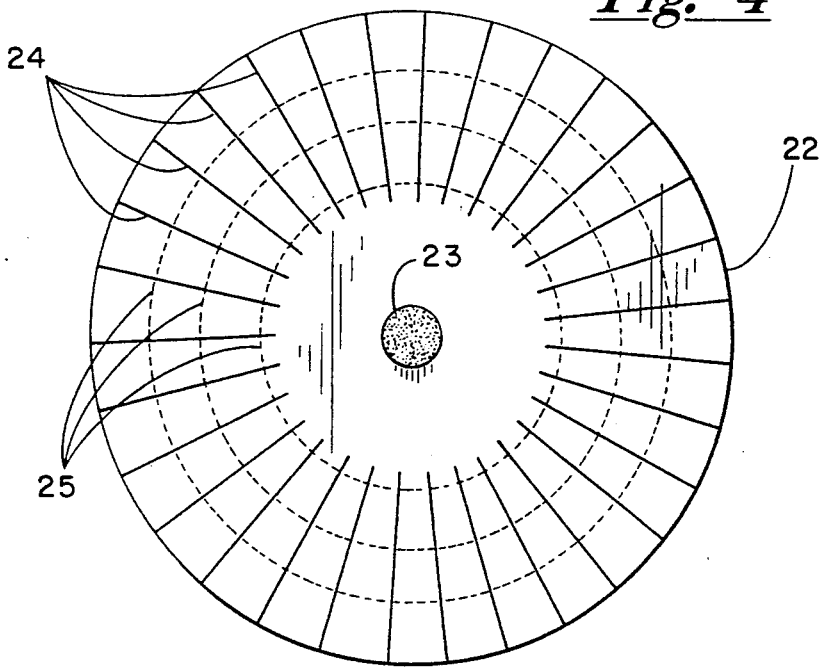
FIG. 4 is an illustration of a preferred form of a ballast disc.

As illustrated in FIG. 4, disk 22 can be constructed to have removable ballast. The disc can be made of some relatively lightweight silvered paper. It has radial and concentric score lines 24 and 25 respectively to make it convenient to reduce the ballast by removing small sections. To allow the toy to elevate, ballast is removed and to have it hover or float at a lower level, more ballast may be added in some convenient fashion. In the former case it has been found that when the toy is then spun downward using the pegs 15 and 16 it will react like a stringless yo-yo and come right back up. In the latter case, when the toy is spun upward it comes back down quickly like a ball tossed into the air.

I claim:

1. For a lighter-than-air gas inflatable hoverable toy having a pair of substantially identical silvered Mylar panels, each panel having a center, said panels sealed together along their edges to form an envelope for receiving lighter-than-air gas in the interior of the envelope, the improvement comprising:

a pair of rigid lightweight stems, each stem having two ends and attached at one end to and extending outward from the center of each of said panels, said stems being lightweight to allow the toy to be buoyant when the envelope is filled with lighter-than-air gas and to provide ballast, said stems being grasped by a user's fingers for spinning the toy about an axis defined by a line between the center of said stems to cause the toy to freely move aerodynamically in response to the spinning action when the stems are released.

2. The inflatable toy as described in claim 1 wherein said panels are generally circular.

3. The inflatable toy as described in claim 1 wherein said stems are short stubs and further including a disc of silvered Mylar surrounding each stem at the panel end for adhesively holding the stem onto the panel.

4. The inflatable toy as described in claim 1 further including pressure-sensitive fastener means on the other ends of said stems for removably attaching articles thereto.

* * * * *